US007713031B2

(12) United States Patent
Dane

(10) Patent No.: US 7,713,031 B2
(45) Date of Patent: May 11, 2010

(54) SUBMERSIBLE PUMP APPARATUS AND METHOD FOR USING SAME

(75) Inventor: Willis Dane, Peru, IL (US)

(73) Assignee: Aqua Control, Inc., Spring Valley, IL (US)

( * ) Notice: Subject to any disclaimer, the term of this patent is extended or adjusted under 35 U.S.C. 154(b) by 697 days.

(21) Appl. No.: 11/599,949

(22) Filed: Nov. 15, 2006

(65) Prior Publication Data

US 2008/0112819 A1 May 15, 2008

(51) Int. Cl.
*F04B 53/00* (2006.01)

(52) U.S. Cl. ..... 417/61; 417/423.3; 415/7; 114/331

(58) Field of Classification Search ..... 417/61, 417/423.3, 337; 415/7; 416/84–86; 15/1.7; 114/331, 245; 212/195; 261/91, 93; 405/52, 405/79

See application file for complete search history.

(56) References Cited

U.S. PATENT DOCUMENTS

| | | | | | |
|---|---|---|---|---|---|
| 3,066,324 | A | * | 12/1962 | Snyder et al. | 441/22 |
| 3,169,921 | A | | 2/1965 | Griffith | |
| 3,618,150 | A | * | 11/1971 | Anselmi | 441/16 |
| 3,664,457 | A | * | 5/1972 | York | 182/70 |
| 4,030,859 | A | | 6/1977 | Henegar | |
| 4,086,306 | A | | 4/1978 | Yoshinaga | |
| 4,242,199 | A | | 12/1980 | Kelley | |
| 4,308,137 | A | | 12/1981 | Freeman | |
| 4,849,101 | A | | 7/1989 | Desjardins | |
| 4,952,184 | A | * | 8/1990 | Graziano | 441/77 |
| 5,071,550 | A | | 12/1991 | Bernhardt | |
| 5,234,582 | A | * | 8/1993 | Savoie | 210/163 |
| 5,417,553 | A | * | 5/1995 | Gibson et al. | 417/366 |
| 6,241,221 | B1 | | 6/2001 | Wegner et al. | |
| 6,439,853 | B2 | | 8/2002 | Tormaschy et al. | |
| 2004/0214664 | A1 | * | 10/2004 | Marra et al. | 473/422 |

* cited by examiner

*Primary Examiner*—Devon C Kramer
*Assistant Examiner*—Todd D Jacobs
(74) *Attorney, Agent, or Firm*—Knechtel, Demeur & Samlan

(57) ABSTRACT

A submersible pump apparatus comprising a housing containing all the components of the pump assembly for using the submersible pump apparatus in a body of water. A float or a plurality of floats are attached to the top side of the housing for providing a positive buoyancy to the submersible pump apparatus. The float is provided with a channel for slidably receiving a single weight or a plurality of weights. The weight is used to overcome the positive buoyancy of the float and achieve a negative buoyancy for submerging the submersible pump apparatus to the bottom of the body of water. A sled is attached to the bottom side of the housing and comprises the combination of both legs and feet for supporting the submersible pump apparatus at the bottom of a body of water. A finder float floating at the water surface level is attached using a rope to both the weight and the housing. By removing the weight or weights from the float, a positive buoyancy is restored to raise the submersible pump apparatus.

14 Claims, 8 Drawing Sheets

SUBMERSIBLE PUMP APPARATUS AND METHOD FOR USING SAME

I. FIELD OF THE INVENTION

The present invention relates to submersible pumps and, more particularly, to a submersible pump apparatus that is uniquely designed to be installed, used, and retrieved from a body of water.

II. DESCRIPTION OF THE PRIOR ART

Submersible pumps such as circulation or aeration devices are commonly used for creating directional flow in a pond or lake to turn still, stagnant water into a stream environment. This helps, among other things, to add vital oxygen to the water and improve pond or lake aeration; reduce aquatic plant growth and inhibit mosquito reproduction; and protect permanent fixtures in the water such as docks, etc . . .

Some examples of circulation or aeration devices are disclosed in the following identified patents, listed below by order of issuance.

| Inventor | Issued | Title of Patent | U.S. Pat. No. |
|---|---|---|---|
| Tormaschy | Aug. 27, 2002 | Water Circulation Apparatus and Method | 6,439,853 |
| Wegner | Jun. 05, 2001 | Waste Pond Liquid Circulation System Having An Impeller and Spaced Pontoons | 6,241,221 |
| Bernhardt | Dec. 10, 1991 | Apparatus For Cleaning And Aeration of Open Bodies of Water | 5,071,550 |
| Desjardins | Jul. 18, 1989 | Aeration Device With A Protection Skirt | 4,849,101 |
| Freeman | Dec. 29, 1981 | Water Aeration And Circulation Apparatus | 4,308,137 |
| Kelley | Dec. 30, 1980 | Aerator Apparatus | 4,242,199 |
| Yoshinaga | Apr. 25, 1978 | Centrifugal Pump | 4,086,306 |
| Henegar | Jun. 21, 1977 | Floating Aerator Having Means To Vary The Length of the Draft Pipe | 4,030,859 |
| Griffith | Feb. 16, 1965 | Pond Water Circulator, Aerator, and Foam Formation Eliminator | 3,169,921 |

These devices fall generally into two types of circulation or aeration devices: (i) those devices that float along the top surface of the water; and (ii) those devices that rest along the bottom surface of the water.

With respect to the first type of devices, these include the following patents. U.S. Pat. No. 6,439,853 discloses a circulation device equipped with an impeller fitted over the top of a draft tube through which water from a pond or reservoir is drawn. Water is drawn up into the draft tube by the pressure differential generated by the impeller and then discharged radially outward from the impeller across a large diffuser plate with a laminar flow diffuser lip to inhibit the passage of water back to the pond to increase the efficiency of the apparatus. This generates the desired liquid circulation.

U.S. Pat. No. 6,241,221 discloses a waste pond liquid circulator that is comprised of multiple pontoons that extend radially from the base. A motor mounted to the base drives an impeller about the central axis. The impeller is rotated to produce a vortex current of liquid directed upward toward the base. The pontoons are configured to receive the current and direct it radially away from the base through wedged shaped spaces to properly circulate the body of water.

U.S. Pat. No. 5,071,550 discloses an apparatus for cleaning and aerating bodies of water. The device floats on the surface of the body of water. A fan at the top of the apparatus creates a vacuum that sucks air through an air intake pipe into a collection chamber. The vacuum also sucks water through a filter into the collection chamber. Inside the collection chamber the air aerates and agitates the water. The water is then discharged out of the chamber through several discharge tubes and the air is discharged past the fan through a discharge pipe.

U.S. Pat. No. 4,308,137 discloses a treatment apparatus for a body of water. The device comprises flotation devices supporting a driving or motor mechanism above the water surface and a circulation or agitation device below the surface of the water. The motor mechanism actuates the circulation or agitation device such that naturally occurring oxygen-saturated water near the surface is drawn downwardly and mixed with the lower oxygen-deficient water at the bottom of the body of water. Optionally, the motor mechanism also drives a bubble generator so that air bubbles are drawn down with the oxygen-saturated surface water, dissolving into the oxygen-deficient water. Additionally, selective directional control structures can be included for directing the oxygen-saturated discharge stream against nutrient-rich sediment, sludge or residues on the bottom of the body of water.

U.S. Pat. No. 4,030,859 discloses a water circulator for use in a lake, pond, or reservoir. The device comprises a raft with a wind driven shaft for vertical rotation. A mixing chamber is mounted beneath the raft, the upper edge of the chamber being above the surface of the water. At the lower end of the shaft is a propeller within the mixing chamber. A pipe extends from the bottom of the mixing chamber to the bottom of the body of water and is adjustable. Wind rotates the shaft and the propeller, which draws water up from the bottom of the lake through the pipe into the mixing chamber and up over the top edge of the chamber back into the body of water to circulate and aerate the water.

With respect to the second type of devices, these include the following patents. U.S. Pat. No. 4,849,101 discloses an aeration device for oxygenating water contained in an aeration-sedimentation basin. The aeration device comprises a vertical, hollow column with an inlet at the bottom and an outlet at the top. Within the column is an orifice that connects to a pipe of pressurized air which produces an upward jet of air through the column. A skirt surrounds the aeration column. The lower end of the skirt is closed and surrounds the inlet, and the upper end of the skirt is open and extends above the level of the solid accumulations in the basin. The action of the air jet draws water from the upper, open end of the skirt down into the aeration column inlet, where the water is oxygenated by the air jet as it passes through the aeration column and then pumped out of the column outlet back into the basin.

By the addition of the skirt, the aeration device aerates only water that is substantially free of solids.

U.S. Pat. No. 4,242,199 discloses an aerator apparatus used in waste treatment plants for oxygenating waste water as the water is forced through the apparatus by an axial flow impeller. The apparatus sits on the bottom of a body of water. Water is forced vertically upward into a chamber by an axial flow impeller. Once in the chamber, compressed oxidizing gas, such as air, entering into the chamber through an array of ports aerates and agitates the water. The aerated water is then discharged from the chamber horizontally back into the surrounding body of water. Alternatively, the water may be drawn from and discharged in the same or opposite direction, as desired.

U.S. Pat. No. 4,086,306 discloses an oxygenating centrifugal pump for circulating aerated water in a culture pond. The pump is a flat-bottomed cuplike vessel that floats on the pond surface with legs extending down into the water. Each leg is a hollow cylinder with an opening at the bottom to let water into the leg and an opening at the top that opens into the inside of the cuplike vessel. Within the vessel is a cylinder with a motor at the top, opening in the middle to allow water into the cylinder, and an impeller at the bottom connected to the motor by a rod. Also within the cylinder is an air suction pipe. The device works by the motor turning the impeller which creates suction within the cylinder. The force of the suction translates through the legs and draws water into and up the legs, into the inside of the vessel, and into the cylinder. At the same time, the pressure difference generated by the impeller draws air into the cylinder through the air suction pipe. The air aerates and agitates the water within the cylinder and both are expelled from the cylinder past the impeller and back into the pond.

U.S. Pat. No. 3,169,921 discloses a means for circulating and aerating sewage before being discharged into an aquatic pond for its final treatment. The device consists of circulators that are connected to a concrete slab. Each circulator consists of a pipe with many holes drilled into the top along the length of the pipe. Above the circulators is a hood that is elevated above the concrete slab and top level of the pond bed. Pressurized air from an external blower is sent through the circulators and draws water from the pond up under and into the hood and then discharged through an opening of the hood back into the pond. This provides the desired aeration and agitation.

The problem with the above devices and, in particular, the devices that are along the bottom surface of the water is that: (1) the devices can be difficult to install in the correct position and orientation in a body of water; (2) the devices are susceptible to being easily turned over or flipped when being installed or while in operation; (3) the devices often cannot be easily accessed for cleaning once installed; (4) the devices are difficult to move or be reoriented; (5) the devices are difficult to remove from the body of water; and/or (6) if the silt depth is unknown, the devices do not disclose a means for preventing the device from sinking or being absorbed into the silt depth and being rendered useless. This often occurs, for example, with devices having concrete slabs or leg supports.

Applicant's inventive submersible pump device and the method for installing, using, and retrieving the inventive submersible pump solves these problems. Thus, there is a need and there has never been disclosed Applicant's unique submersible pump.

III. SUMMARY OF THE INVENTION

The present invention is a submersible pump apparatus comprising a housing containing all the components of the pump assembly for using the submersible pump apparatus in a body of water. A float or a plurality of floats are attached to the top side of the housing for providing a positive buoyancy to the submersible pump apparatus. The float is provided with a channel for slidably receiving a single weight or a plurality of weights. The weight is used to overcome the positive buoyancy of the float and achieve a negative buoyancy for submerging the submersible pump apparatus to the bottom of the body of water. A sled is attached to the bottom side of the housing and comprises the combination of both legs and feet for supporting the submersible pump apparatus at the bottom of a body of water. A finder float floating at the water surface level is attached using a rope to both the weight and the housing. By removing the weight or weights from the float, a positive buoyancy is restored to raise the submersible pump apparatus.

IV. BRIEF DESCRIPTION OF THE DRAWINGS

The Description of the Preferred Embodiment will be better understood with reference to the following figures:

FIG. 1*a* is a side perspective view of Applicant's submersible pump apparatus.

FIG. 1*b* is an end view of the submersible pump apparatus.

FIG. 2*a* is a cross sectional view, taken along line 2*a*-2*a* of FIG. 1*a*, illustrating, in particular, the pump assembly contained within the housing and the receiving channel contained within the floats.

FIG. 2*b* is a side perspective view, with portions removed, of the float and the receiving channel contained within the float.

FIG. 2*c* is a side perspective view of the weight that is received into the receiving channel of the floats.

Figure 5A:
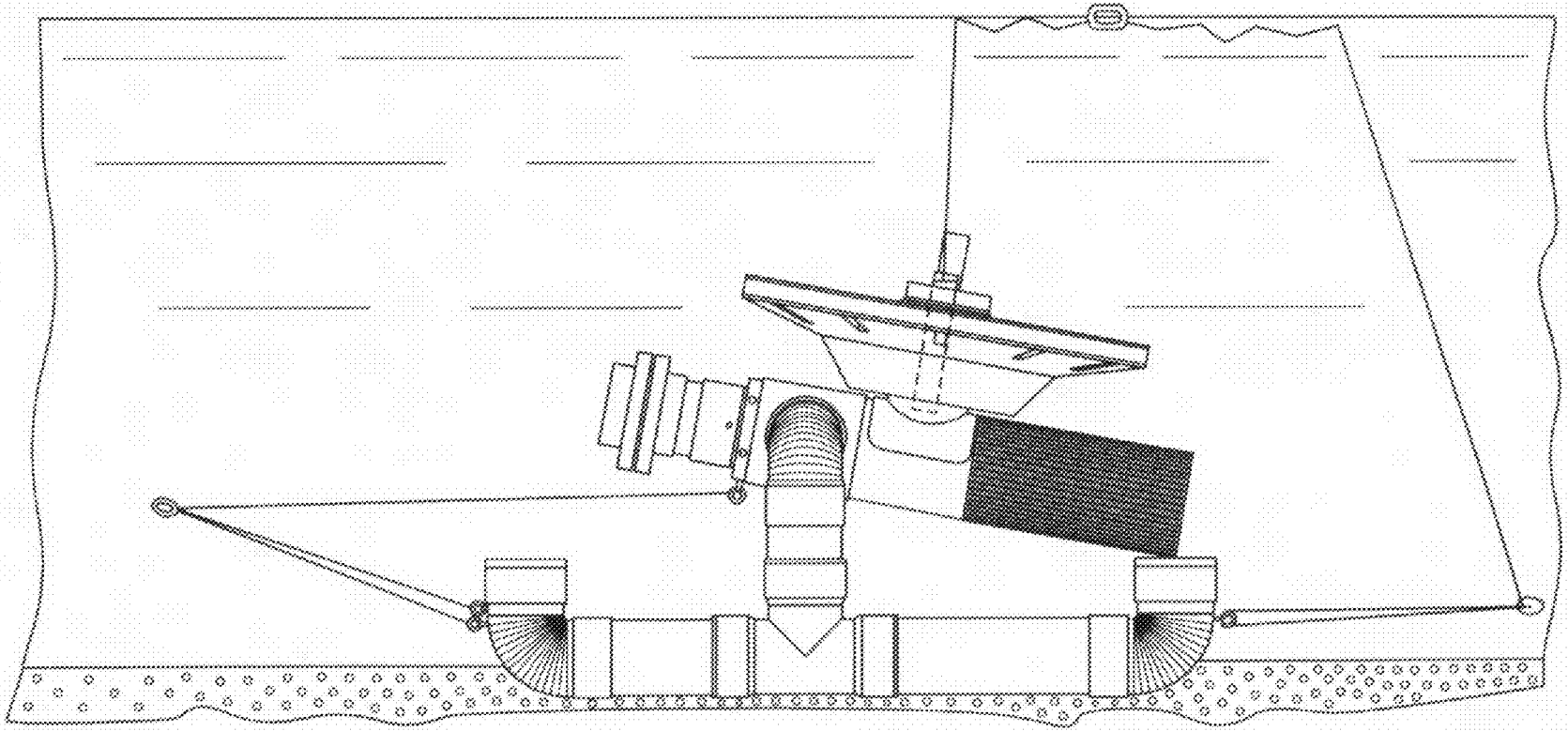

FIG. 5*a* is a side perspective view of an alternate embodiment of Applicant's submersible pump apparatus.

Figure 5B:
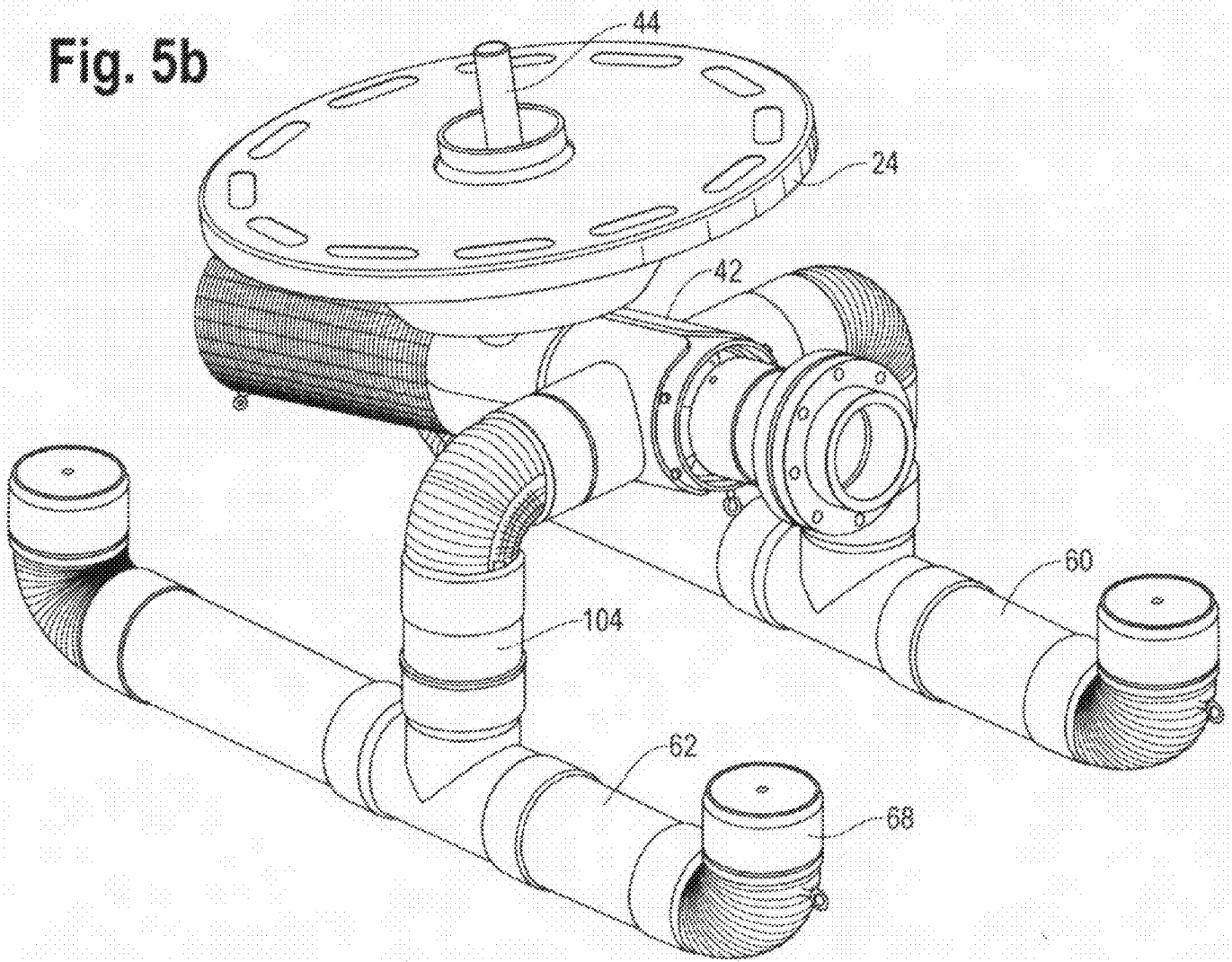

FIG. 5*b* is a side perspective view of the alternate embodiment of Applicant's submersible pump apparatus.

V. DETAILED DESCRIPTION OF THE PREFERRED EMBODIMENT

Figure 3:
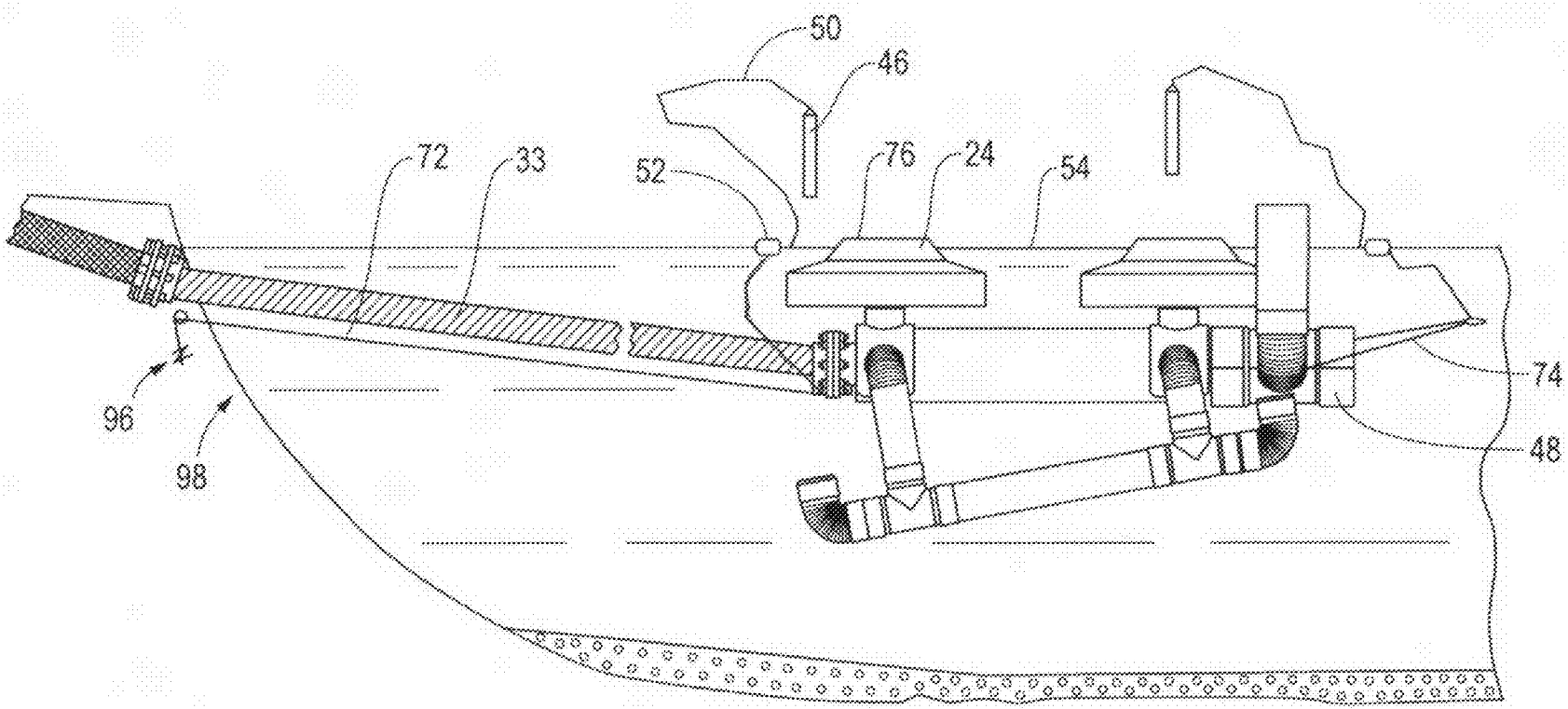
FIG. 3 is a side perspective view of the submersible pump apparatus at it resides at the water surface level while in the process of being installed in a body of water.

Turning first to FIG. 1, there is illustrated a submersible pump apparatus 20. The submersible pump 20 comprises a housing 22, floats 24, and a sled 26. The housing 22 is an elongated tube having a proximal end 28 and a distal end 30. A flexible tubing hose 33 is attached to the proximal end 28 of the housing 22 by a flange connection 32 using bolts 34 and nuts 36. Alternatively, it is contemplated that any other means known to one skilled in the art may be used for securing the flexible tubing hose 33 to the housing 22. As discussed in more detail below, a front eye-bolt 38 is attached to the flange connection 32 and a rear eye-bolt 48 is attached adjacent to the distal end 30 of the housing 22. Alternatively, the front eye-bolt 38 and the rear eye-bolt 48 may be attached to any portion of the housing 22. The rear eye-bolt 48 may also be separated into two rear eye-bolts 48 attached on opposite sides of the housing 22, as illustrated in FIG. 3. Situated adjacent to the distal end 30 of the housing 22 are also suction tubes and screens 40.

In the preferred embodiment, each float 24 is rotationally molded into a single piece forming a hollow shell and having a homogeneous surface without any seams. Each float 24 is preferably made of a polyethylene plastic material. The hollow shell is then filled with a urethane foam. In this manner, the homogeneous surface assures leak free integrity, the foam filling provides rigidity and strength to the shell, and should the shell be damaged while submerged under water, the foam provides closed cells to prevent water from being absorbed within the float 24 and sinking the submersible pump 20. The float 24 is also preferably black in color, ultraviolet light resistant, and provides a material that is impervious to water. Alternatively, it is contemplated that the float 24 may be made of any other type of material or properties known to one skilled in the art provided that it can be used in the manner described herein.

In the preferred embodiment, the floats 24 each have a density that is less than water to thereby provide a positive buoyancy to the submersible pump 20. Although the floats 24 may have any desired shape, the buoyancy of the floats 24 are more convenient or practical if the floats 24 have a relatively smaller thickness and larger diameter. In the preferred embodiment, one float 24 is attached adjacent to the proximal end 28 of the housing 22 and the other float 24 is attached adjacent to the distal end 30 of the housing 22. Depending upon the weight of the submersible pump 20 from the proximal end 28 to the distal end 30, the buoyancy provided by each float 24 is sufficient to overcome the weight along each end. For example, if the weight along the proximal end 28 of the submersible pump 20 is substantially equal to the weight along the distal end 30, then the buoyancy provided by each of the floats 24 will be substantially equal. If, however, the weight along the proximal end 28 is more or less than the weight along the distal end 30, then the float 24 located adjacent the proximal end 28 will have a buoyancy that is equivalently more or less than the buoyancy of the float 24 located adjacent the distal end 30. In this manner, the location and buoyancy of the floats 24 coact to stabilize the submersible pump 20 in an upright, balanced orientation when submerged in the body of water.

The floats 24 also coact for preventing the submersible pump 20 from rotating in any one direction to permanently change the upright, balanced orientation of the submersible pump 20. For example, should the body of water experience turbulent conditions forcing the submersible pump 20 into unusual orientations, the floats 24, which are situated above the center of gravity of the submersible pump 20, are sufficient to always counterbalance any such affects and thereby return or re-orient the submersible pump 20 back to its upright, balanced orientation. Alternatively, the number of the floats and the location of the floats 24 may be anywhere along the housing 22 provided that the number, location, and buoyancy of the floats 24 are sufficient to maintain the upright, balanced orientation of the submersible pump 20.

In the preferred embodiment, each float 24 provides a receiving channel 44 for receiving a weight 46. The receiving channel 44 is more clearly illustrated in FIGS. 2*a* and 2*b*. Preferably, the receiving channel 44 is a six inch (6") pipe. Alternatively, the receiving channel 44 may be larger or smaller or made of any other materials known to one skilled in the art provided that it is used in the manner described herein.

Each float 24 is fixedly attached to the housing 22 using a mount 4 1. The mount 41 is preferably fixedly secured to the housing 22. Alternatively, any means known to one skilled in the art for fixedly attaching the float 24 to the housing 22 may be used.

Figure 2A:
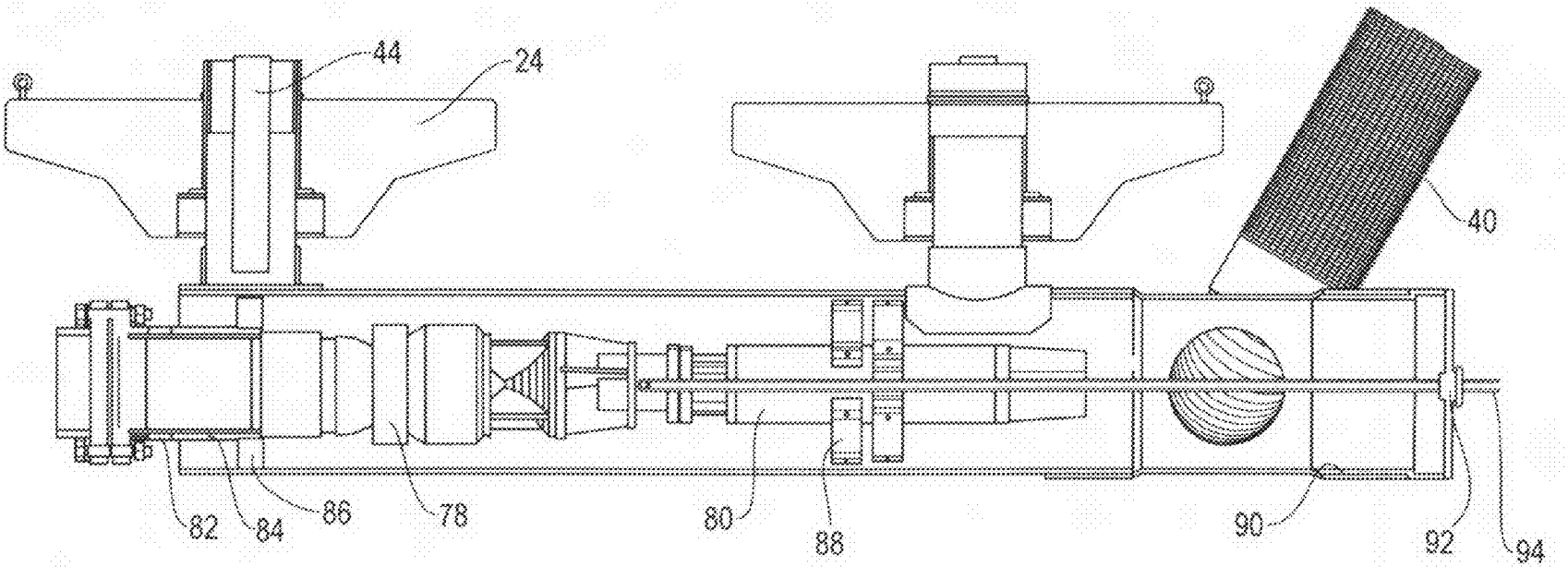
Figure 2B:
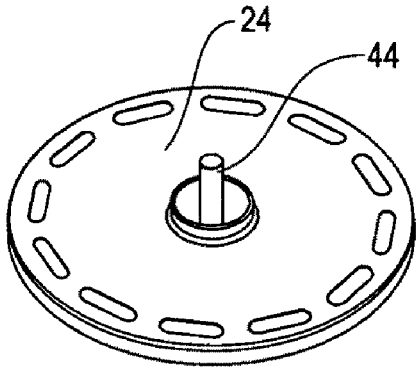
Figure 2C:
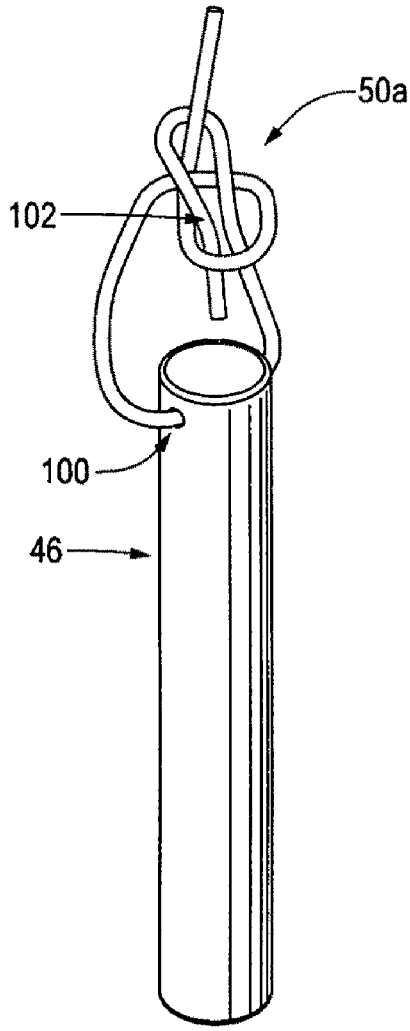

The weight 46 may be a single weight or multiple weights of varying sizes. The weight 46 should be shaped for being slidably received into the receiving channel 44. In the preferred embodiment, the weight 46 is a round bar having a weight of about five (5) to ten (10) pounds in water, as illustrated in FIG. 2*c*. The weight 46 may be made of any material including but not limited to any non-rusting material such as aluminum, metal encased within a plastic coating, polyvinyl, cast iron, or any material known to one skilled in the art. Alternatively, any material or size/weight for the weight 46 may be used provided that it provides a specific gravity in water to be used in the manner described herein.

In the preferred embodiment, the single weight 46 or the last weight 46 (if multiple weights are used) received into the receiving channel 44 is attached to a finder float rope 50. As illustrated in FIG. 2*c*, the weight 46 is provided with a hollow passageway 100 that extends through the entire thickness of the weight 46. The hollow passageway 100 is preferably located adjacent one end of the weight 46. The finder float rope 50 is inserted through the hollow passageway 100 and a knot 102 is formed in the finder float rope 50 for securing the finder float rope 50 to the weight 46. Alternatively, any other means for fixedly securing the finder float rope 50 to the weight 46 may be used.

Referring back to FIG. 1*a*, the portion of the finder float rope, identified by reference number 50a, extends from the weight 46 to a finder float 52 floating at the water surface level 54. The finder float rope 50*a* should be of sufficient length to accommodate the distance between the submersible pump 20 and the finder float 52. From the finder float 52, the portion of the finder float rope, identified by reference number 50*b*, extends back down and attaches to the front eye-bolt 38 or the rear eye-bolt 48, respectively. In this manner, the weight 46 and the finder float 52 remain secured to the submersible pump 20. It is further contemplated that the finder float rope 50 can be any type of rope, twine, wire, or any other material known to one skilled in the art. The finder float rope 50 preferably has qualities that make it impervious to water thereby avoiding unnecessary deterioration and usefulness. Alternatively, if the finder float rope 50 does not contain these qualities, this too is sufficient although the finder float rope 50 may need to be repaired or replaced more often.

The finder float 52 may be any floatation device provided that it floats along the water surface level 54. Also, the finder float 52 may be of any color or color combination to assist in visibly locating the finder float 52 at the water surface level 54. Bright colors such as red, yellow, orange, etc . . . may be used. Alternatively, depending upon the preference of the user and/or the size of the body of water, any color may be acceptable.

The sled 26 comprises opposed legs 56, opposed legs 58, and feet 60 and 62. In the preferred embodiment, the sled 26 is made of a hollow polyvinyl plastic material, commonly known as PVC plastic material. Alternatively, it is contemplated that the opposed legs and feet may be made of any other type of material known to one skilled in the art provided that they can be used in the manner described herein.

Opposed legs 56 and opposed legs 58 each extend outwardly and down from adjacent the proximal end 28 or distal end 30 of the housing 22, respectively. This is also more clearly illustrated in FIG. 1*b*. Preferably, the opposed legs 56 and opposed legs 58 are each attached and secured to the housing 22 using a mount 42. Each of the opposed legs 56 and opposed legs 58 are also attached to the corresponding feet 60 and 62 using a coupling means 64. Alternatively, it is contemplated that any variation from a single leg to a combination of multiple legs (as depicted) may be used in combination with a single foot or a combination of feet (as depicted) to connect the housing 22 to the sled 26.

Caps 68 are attached to the ends of each of the feet 60 and 62 and are used to prevent mud or other debris from getting into the feet 60 and 62 of the sled 26. As depicted, the feet 60, 62 of the sled 26 rest primarily on top of the silt 70 or the bottom of the body of water.

In the preferred embodiment, the sled 26 is designed to provide a minimal amount of weight over a larger surface area between and from the ends of foot 60 to foot 62. In this manner, the weight of the sled 26 is dispersed such that it assists, in combination with the floats 24, to permit the submersible pump 20 to rest very lightly on the silt 70. Alternatively, even if no sled 26 were present, the submersible pump 20 can still achieve the same results with the floats 24 only.

Also the feet 60 and 62 have a length that extends substantially the length of the housing 22. In this manner, should the submersible pump 20 move or be forced across the silt 70, the feet 60 and 62 act as a sled runner for the sled 26 to skim across the top surface of the silt 70.

Figure 4:
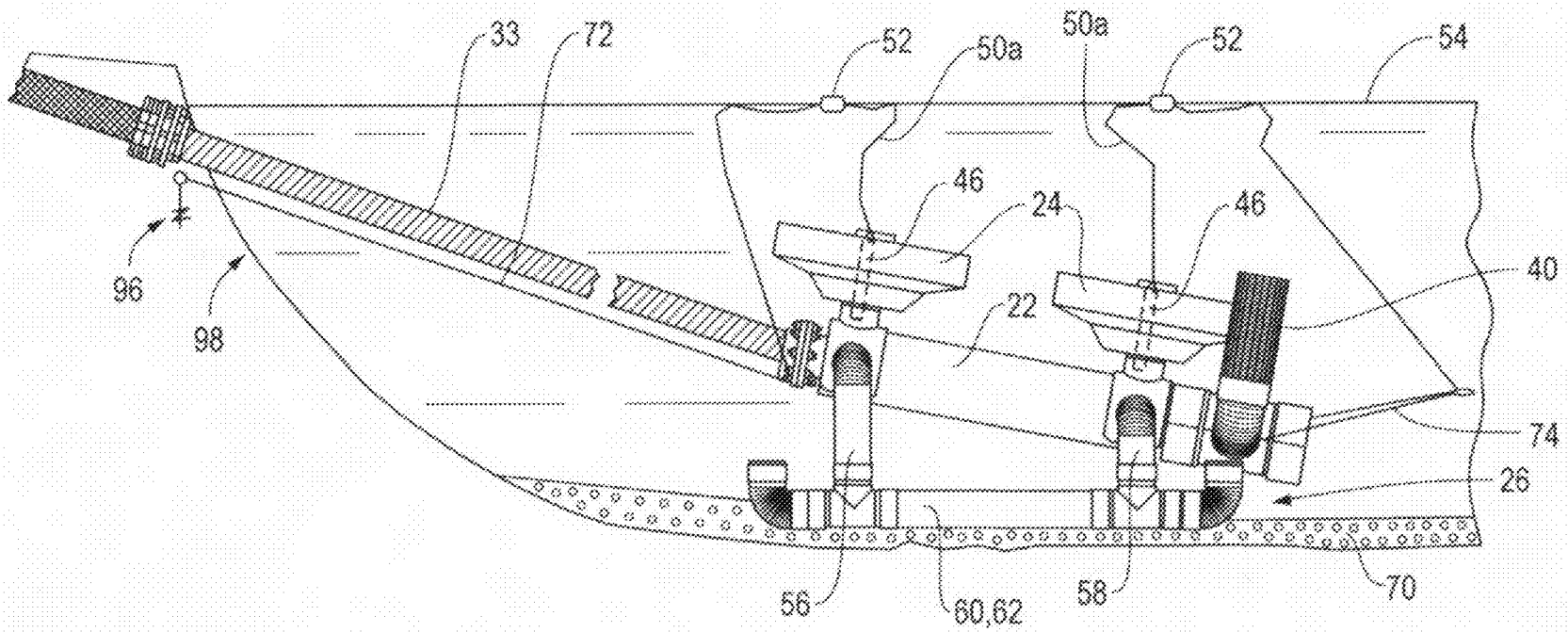
FIG. 4 is a side perspective view of the submersible pump apparatus at it resides at the bottom of the body of water upon being installed.

A mooring or anchoring line 72 is attached at one end to the front eye-bolt 38 and at the other end to a mooring or anchoring stake 96 on the shoreline or land 98 (See FIGS. 3 and 4). A tow line 74 is attached to the rear eye-bolt 48.

To install the submersible pump 20 in any body of water, the process begins as illustrated in FIG. 3. Using the tow line 74, the submersible pump 20 is pulled out into the body of water to a desired location. It is contemplated that any means for pulling the submersible pump 20 out into the body of water is acceptable. For example, in small bodies of water, a person with the tow line 74 may stand on the ground alongside the body of water and pull the submersible pump 20 from that location. In larger bodies of water, any type of manual or power boat may be used to pull or transport the submersible pump 20 to the desired location in the body of water. The flexible tubing 33 and mooring line 72 are both pre-attached to the submersible pump 20. Alternatively, it is contemplated that the flexible tubing 33 and the mooring line 32 may be attached to the submersible pump 20 at any time prior to submerging the submersible pump 20. When the submersible pump 20 is being pulled to the desired location, the floats 24 act as floatation devices for maintaining the submersible pump 20 at the water surface level 54. In this manner, the top of the floats 76 remain visibly exposed while the remainder of the floats 24 and submersible pump 20 are held floating just under the water surface level 54.

When the desired location is reached, weights 46 are then inserted into the receiving channel 44 (see FIGS. 2*a* and 2*b*) of the floats 24. In the preferred embodiment, the totality of the weight 46 inserted into each float 24 should be of sufficient weight to just overcome the buoyancy provided by the floats 24 thereby creating a negative buoyancy. As previously described, the weight 46 may be a single weight or a combination of any number of weights. If the weight 46 is a single weight, the weight of the single weight will be sufficient to obtain this negative buoyancy. If the weight 46 is the combination of any number of weights, a first weight is inserted into the receiving channel 44 of the float 24. The first weight will proceed to the bottom of the receiving channel 44. A second weight is then inserted into the receiving channel 44 directly behind and abuting the first weight. A third weight, fourth weight, etc . . . are then inserted into the receiving channel 44 in successive order directly behind the second weight. At some point, the combined weight of the first weight, second weight, third weight, fourth weights, etc . . . inserted into the receiving channel 44 will be sufficient to obtain the negative buoyancy in the float 24. When this occurs, the single weight or the last weight inserted is attached to the finder float rope 50. Preferably, each of the weights 46 are substantially the same size and weight of about five (5) to ten (10) pounds in water.

As the buoyancy of the floats 24 are no longer able to sustain the submersible pump 20 at the water surface level 54 and negative buoyancy is achieved (referred to herein as "sinking weight"), the submersible pump 20 will begin to sink and continue to sink until it reaches the bottom of the body of water, as illustrated in FIG. 4. During this submerging, the floats 24 maintain the submersible pump 20 in an upright, balanced orientation within the body of water.

This process can be further illustrated in the following non-limiting example. For example, the typical weight of the submersible pump 20 can be anywhere between fifty (50) pounds and five hundred (500) pounds. If we assume that the submersible pump 20 has a weight of two hundred (200) pounds and this weight is uniformly distributed across the housing 22 from the proximal end 28 to the distal end 30, each of the floats 24 will provide substantially the same buoyancy of at least two hundred (200) pounds. If we assume the buoyancy of the floats 24 is two hundred and twenty (220) pounds, this means that the floats 24 have a reserve buoyancy of twenty (20) pounds. If we assume that each weight 46 weights approximately five (5) pounds, the first four weights 46 inserted into each of the receiving channel 44 of the floats 24 will total twenty (20) pounds thereby increasing the total weight of the submersible pump 20 to equal the reserve buoyancy provided by the floats 24. Upon inserting the next five (5) pound weight 46 into each of the floats 24 will exceed the reserve buoyancy and create a negative buoyance of five (5) pounds in each float 24. When this occurs, the sinking weight is achieved and the submersible pump 20 will sink to the bottom of the body of water.

As the above is a non-limiting example, the weight of the submersible pump 20, the reserve buoyancy of the floats 24, and the weight of the weights 46 may be any variation of weights. However, the reserve buoyancy of the floats 24 must at least be larger than the weight of the submersible pump 20 and the total weight of the weight 46 must at least be larger than the reserve buoyancy of the floats 24 to obtain the negative buoyancy or sinking weight. Accordingly, the less or larger the reserve buoyancy provided by the floats, the less or larger the weight of the weights 46 that will be necessary to achieve the negative buoyancy.

When the submersible pump 20 reaches the bottom of the body of water, the finder float rope 50*a* remains attached to the weight 46. The remaining portion of the finder float rope 50*b* is attached to the submersible pump 20 to keep the finder float 52 and weight 46 secured to the submersible pump 20. In this manner, the finder float 52 remains visible as it floats at the water surface level 54 thereby acting as a marker to locate the submersible pump 20 for later identification of the submersible pump 20, servicing, and/or retrieval.

Also, when the submersible pump 20 reaches the bottom of the body of water, the sled 26 comes to rest on the bottom of the body of water. As the negative buoyancy is created using the minimum amount of weight, the submersible pump 20 is able to achieve a resting position sufficiently on top of the silt 70 at the bottom of the water. For example, using the same example from above, the submersible pump 20 has a combined ten (10) pounds of negative buoyancy or weight in the water (i.e., five (5) pounds from the weights in each float 24). Although the silt 70 has a very low weight bearing capacity, this ten (10) pounds of negative buoyancy or weight in the water prevents the submersible pump 20 and, in particular, the sled 26, from sinking deeply into the silt 70 at the bottom of the body of water. Due to the minimal weight of the submersible pump 20 achieved, the feet 60 and 62 of the sled 26, engage and become partially submerged into the silt 70 while the remaining portion of the feet 60 and 62 remain primarily exposed, resting above the silt 70. In this manner, the submersible pump 20 and including the sled 26 remain crested on top of the silt 70 for use and later retrieval. Alternatively, any negative buoyancy or weight in the water of the submersible pump 20 can be used provided that it prevents the submersible pump 20 from sinking deeply into the silt 70 and inhibiting the use, servicing, and/or retrieval of the submersible pump 20.

Figure 1A:
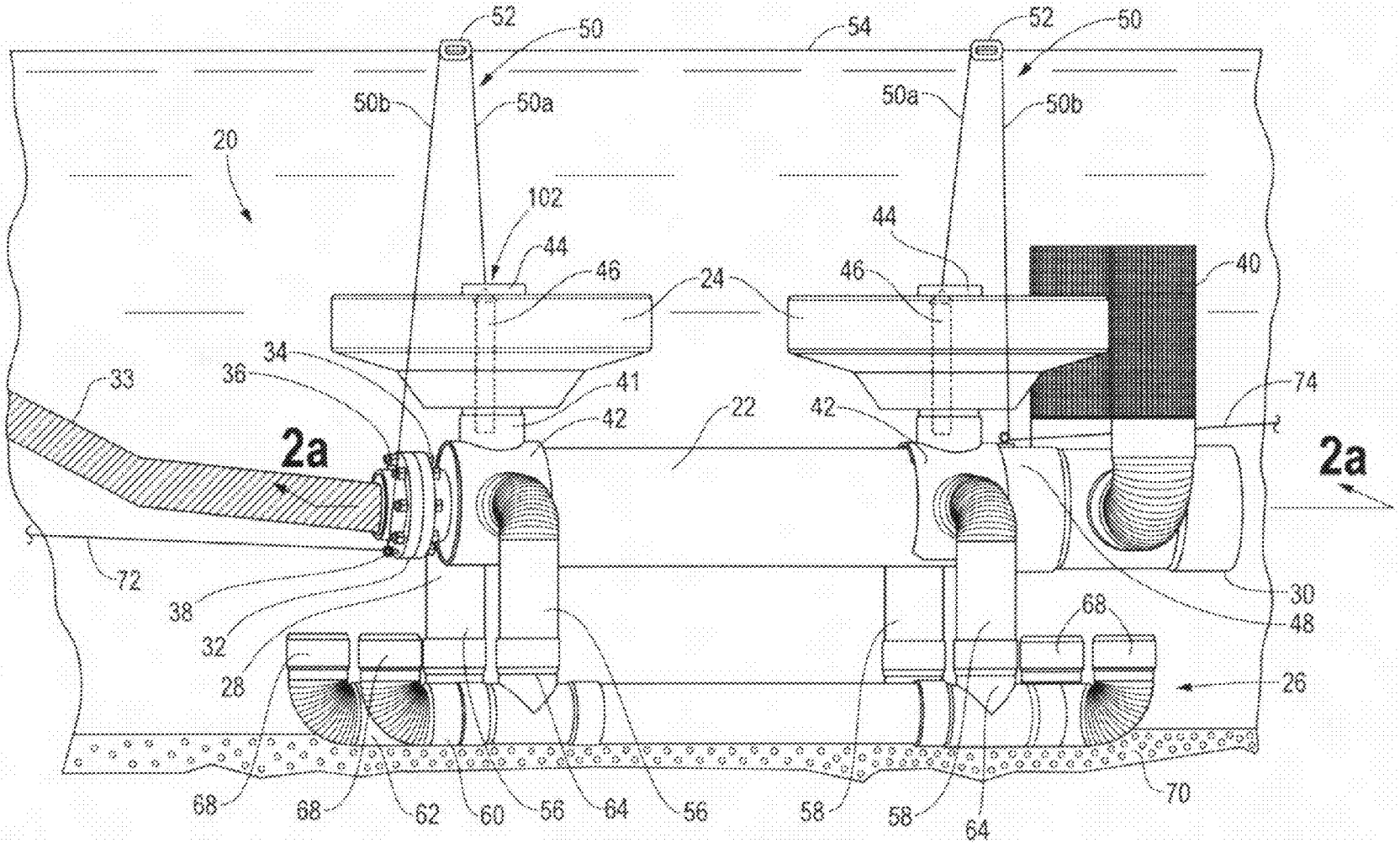
Figure 1B:
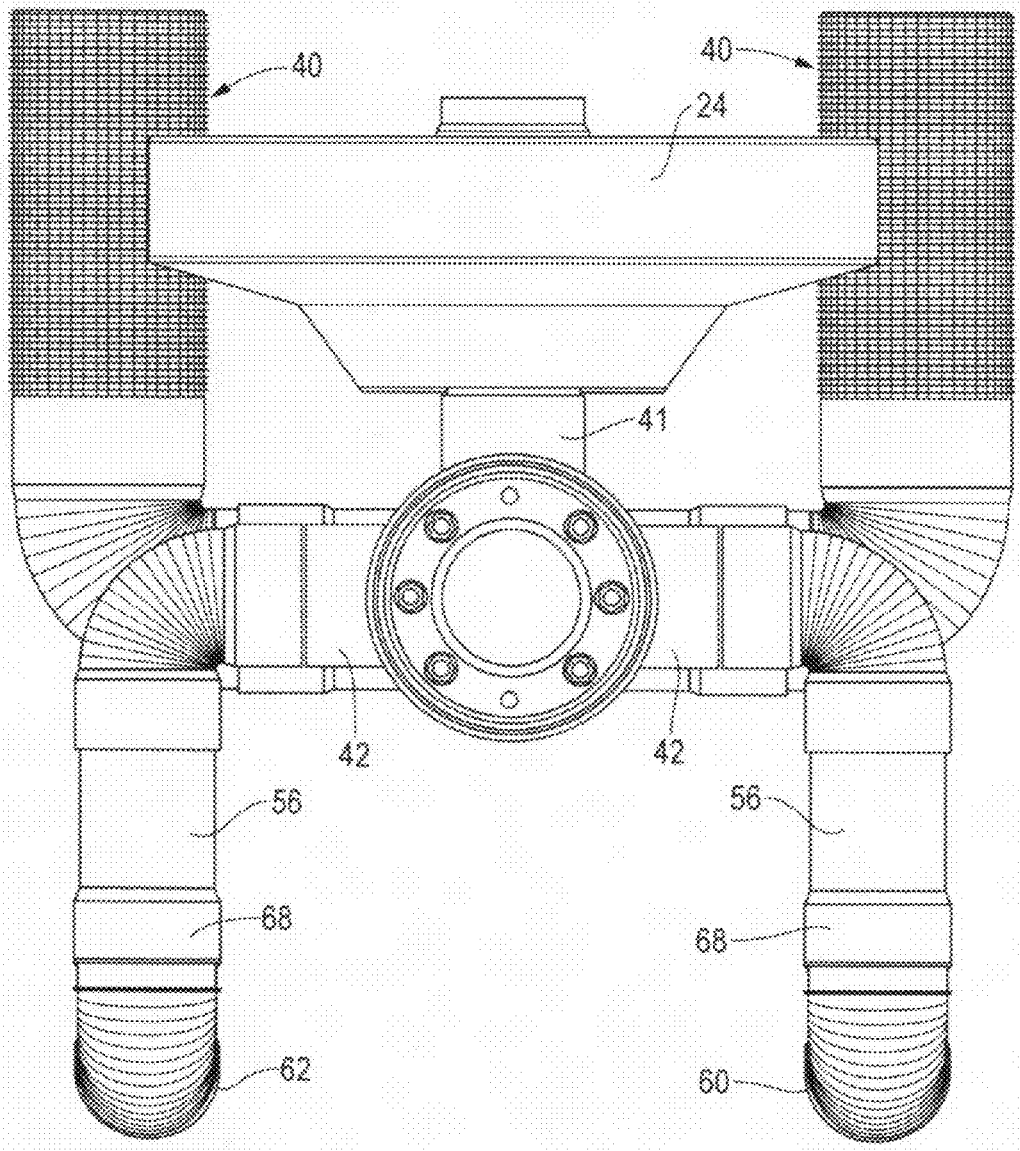

Also, the legs 56 and 58 of the sled 26 create a separation of water between the housing 22 and the feet 60 and 62. As depicted in FIGS. 1*a* and 1*b*, the legs 56 and 58 may either be equal in length or, as depicted here in FIG. 4, the legs 56 may have a longer length than legs 58.

The submersible pump 20 is now in position and ready for use like any other submersible pump known to one skilled in the art. Essentially, the submersible pump 20 pulls in water through the suction tube and screens 40, through the pump assembly contained within the housing 22, and discharges the water into the flexible tubing hose 33. As depicted in FIG. 2*a*, the submersible pump 20 accomplishes this using the pump assembly components of a pump 78 and motor 80. Other components include but are not limited to a nipple 82, a pvc spacer 84, a pump support 86, a motor support 88, a plug 90, a rubber plug 92, and a motor lead wire 94. Alternatively, any means known to one skilled in the art for using the submersible pump 20 in this manner may be used.

Referring back to FIG. 4, the mooring line 72 and tube hose 33 preferably coact to prevent the submersible pump 20 from moving in the backward direction due to the thrust forces exerted from the pump while in use. The mooring line 72 and tube hose 33 also assist in keeping the submersible pump 20 pointed in the correct direction and vertical orientation.

If the submersible pump 20 is required to be removed from the body of water for servicing or replacement, the finder floats 52 are located. Each finder float rope 50*a* is then pulled in the upward direction such that the weight 46 attached to finder float rope 50*a* is likewise pulled in the upward direction. When the weight 46 is sufficiently pulled, the weight 46 slides out of and is released from the receiving channel 44. Without the weights 46, the buoyancy of the submersible pump 20 is reversed. The negative buoyancy is removed and the positive buoyancy provided by the floats 24 is reestablished. In this manner, the floats 24 begin to lift the submersible pump 20 from the bottom of the body of water towards the water surface level 54. If the mud or other debris happens to restrain the submersible pump 20 preventing the positive buoyancy of the floats 24 from lifting the submersible pump 20 to the water surface level 54, the finder float rope 50*b* can be pulled in the upward direction providing an upward force on the housing 22 to overcome and release the submersible pump 20 from the restraining debris. Once the submersible pump 20 reaches the water service level 54, the submersible pump 20 is then accessible for servicing or removal.

In an alternate embodiment, the submersible pump 20 may utilize a single float 24 or a single set of legs, as illustrated in FIGS. 5*a* and 5*b*, to accomplish the same results as described herein.

It is contemplated that the submersible pump 20 can be used as a bottom circulator, waterfall and stream pump, irrigation pump, de-watering pump, transfer pump, irrigation pump, irrigation pump station feed pump, and/or any other related pumping applications where the water source is a pond, lake, or other body of water, and/or any other means known to one skilled in the art.

Thus, there has been provided a unique apparatus and method for installing, using, and retrieving a submersible pump. While the invention has been described in conjunction with a specific embodiment, it is evident that many alternatives, modifications and variations will be apparent to those skilled in the art in light of the foregoing description. Accordingly, it is intended to embrace all such alternatives, modifications and variations as fall within the spirit and scope of the appended claims.

What is claimed is:

1. A submersible pump apparatus for use within a body of water, comprising:

a housing having a top side, a bottom side, and opposed ends defining a proximal end and a distal end and a pump assembly contained within the housing, the housing situated in a substantially horizontal orientation and aligned in a housing plane;

at least one float attached to the top side of the housing and situated in a position above the housing plane, the at least one float having a density that is less than water;

a receiving channel contained within the at least one float and situated in a substantially vertical orientation;

at least one weight;

a rope having opposed ends, one end of the rope attached to the housing and the other end of the rope attached to the weight;

a finder float attached to the rope between the opposed ends, the finder float having a density less than water and floats at a water surface level of the body of water; and wherein, the at least one float provides a positive buoyancy to maintain the at least one float and the housing floating at the water surface level of the body of water; and wherein, upon inserting the weight into the receiving channel of the at least one float, the positive buoyancy is overcome by the weight such that the at least one float and the housing have minimum negative buoyancy to sink to the bottom of the body of water; and wherein, the finder float locates the rope and applying an upward force on the rope attached to the weight causes the weight to be removed from the at least one float and applying an upward force on the rope attached to the housing causes the housing to break free from any suction of silt from the bottom the body of water thereby, as the negative buoyancy is eliminated and the positive buoyancy is re-established, the at least one float and the housing raises back to floating at the water surface level of the body of water.

2. The submersible pump apparatus of claim 1 wherein the weight comprises a hollow passageway wherein the other end of the rope is inserted into and through the hollow passageway and tied into a knot thereby attaching the rope to the weight.

3. The submersible apparatus of claim 1 and further comprising a sled attached to the bottom side of the housing.

4. The submersible apparatus of claim 3 wherein the sled comprises a plurality of opposed legs and a plurality of feet, the plurality of opposed legs each attached to the plurality of feet.

5. The submersible apparatus of claim 4 wherein the plurality of opposed legs are fixedly secured to the housing.

6. The submersible apparatus of claim 1 wherein the weight is made of non-rusting material.

7. The submersible apparatus of claim 3 wherein the sled is made of a plastic material.

8. The submersible apparatus of claim 1 wherein a mooring line is secured to the proximal end of the housing.

9. The submersible apparatus of claim 1 wherein a flexible tube hose is secured to the proximal end of the housing.

10. The submersible apparatus of claim 1 wherein a tow line is secured to the distal end of the housing.

11. A submersible pump apparatus for use within a body of water, comprising:

a housing having a top side, a bottom side, and opposed ends defining a proximal end and a distal end, the housing aligned in a housing plane;

a plurality of floats providing a positive buoyancy to maintain the submersible pump apparatus at a water surface level of the body of water, each of the plurality of floats attached to the top side of the housing and situated in a position above the housing plane;

a receiving channel contained within each of the plurality of floats:

a plurality of weights; and wherein, the plurality of floats provides a positive buoyancy to maintain the plurality of floats and the housing floating at a water surface level of the body of water; and wherein, upon inserting one or more of the plurality of weights into the receiving channel in each of the plurality of floats until the positive buoyancy is minimally overcome by the weight creating a negative buoyancy, the negative buoyancy causes the plurality of floats and the housing to sink to the bottom of the body of water; and wherein, applying an upward force to remove one or more of the plurality of weights from each of the plurality of floats eliminates the negative buoyancy and re-establishes a positive buoyancy raising the plurality of floats and the housing back to floating at the water surface level of the body of water.

12. The submersible apparatus of claim 11 wherein one of the plurality of floats is attached adjacent to the proximal end of the housing.

13. The submersible apparatus of claim 11 wherein one of the plurality of floats is attached adjacent to the distal end of the housing.

14. The submersible apparatus of claim 11 and further comprising a sled attached to the bottom side of the housing.

* * * * *